US009061864B2

(12) United States Patent
Spirgi et al.

(10) Patent No.: US 9,061,864 B2
(45) Date of Patent: Jun. 23, 2015

(54) METHOD FOR OPERATING ELEVATORS TO TEST BRAKES

(75) Inventors: Erich Spirgi, Hergiswil (CH); Daniel Bossard, Sursee (CH); Danilo Peric, Lucerne (CH); Enrique Almada, Obernau (CH); Urs Ammon, Ebikon (CH); Urs Polin, Lucerne (CH); André Peter, Meggen (CH); Thomas Eilinger, Kussnacht am Rigi (CH)

(73) Assignee: Inventio AG, Hergiswil (CH)

( * ) Notice: Subject to any disclaimer, the term of this patent is extended or adjusted under 35 U.S.C. 154(b) by 774 days.

(21) Appl. No.: 13/310,257

(22) Filed: Dec. 2, 2011

(65) Prior Publication Data

US 2012/0217100 A1 Aug. 30, 2012

(30) Foreign Application Priority Data

Dec. 3, 2010 (EP) ..... 10193737

(51) Int. Cl.
*B66B 1/34* (2006.01)
*B66B 5/00* (2006.01)

(52) U.S. Cl.
CPC ..... *B66B 5/0037* (2013.01); *B66B 5/0025* (2013.01)

(58) Field of Classification Search
CPC .. B66B 5/0006; B66B 5/0018; B66B 5/0025; B66B 5/0031; B66B 5/0037
USPC ..... 187/258, 288, 359, 362, 367–369, 371, 187/373, 391–393; 318/362, 363, 369, 371, 318/372
See application file for complete search history.

(56) References Cited

U.S. PATENT DOCUMENTS

| | | | | |
|---|---|---|---|---|
| 5,233,139 | A * | 8/1993 | Hofmann | 187/393 |
| 5,531,294 | A * | 7/1996 | Burton et al. | 187/292 |
| 6,056,088 | A * | 5/2000 | Gerstenkorn | 187/390 |
| 7,222,698 | B2 * | 5/2007 | Hanninen | 187/393 |
| 7,268,514 | B2 * | 9/2007 | DeLange et al. | 318/757 |
| 7,350,883 | B2 * | 4/2008 | Hubbard et al. | 303/191 |
| 7,527,127 | B2 * | 5/2009 | Osterman et al. | 187/391 |
| 7,617,911 | B2 * | 11/2009 | Mattila et al. | 187/391 |
| 7,775,330 | B2 * | 8/2010 | Kattainen et al. | 187/393 |
| 8,602,170 | B2 * | 12/2013 | Fischer | 187/288 |
| 8,746,413 | B2 * | 6/2014 | Schroeder-Brumloop et al. | 187/393 |
| 2010/0154527 | A1 * | 6/2010 | Illan | 73/121 |

FOREIGN PATENT DOCUMENTS

| | | | |
|---|---|---|---|
| EP | 1561718 | A2 | 8/2005 |
| WO | 2004035448 | A2 | 4/2004 |
| WO | 2005066057 | A2 | 7/2005 |
| WO | 2007094777 | A2 | 8/2007 |

* cited by examiner

*Primary Examiner* — Anthony Salata
(74) *Attorney, Agent, or Firm* — Fraser Clemens Martin & Miller LLC; William J. Clemens

(57) ABSTRACT

A method for operating an elevator having a car driven by a motor and at least one brake to stop the car, the method including closing a brake, increasing a torque of the motor until the car moves, and registering a value indicative of the motor torque at which the car moves.

10 Claims, 2 Drawing Sheets

2 COUNTERWEIGHT
4 CAR
5 PULLEY
8 TRACTION SHEAVE
10 DRIVE SHAFT
12 MOTOR
14, 16 BRAKE
18 CONTROL SYSTEM
20 TRANSPONDER
22 ENCODER
28 TEST WEIGHT

METHOD FOR OPERATING ELEVATORS TO TEST BRAKES

CROSS-REFERENCE TO RELATED APPLICATION

This application claims priority to European Patent Application No. 10193737.3, filed Dec. 3, 2010, which is incorporated herein by reference.

FIELD

The present disclosure relates to elevators.

BACKGROUND

A conventional traction elevator typically comprises a car, a counterweight and traction means such as a rope, cable or belt interconnecting the car and the counterweight. The traction means passes around and engages with a traction sheave which is driven by a motor. The motor and the traction sheave rotate concurrently to drive the traction means, and thereby the interconnected car and counterweight, along an elevator hoistway. At least one brake is employed in association with the motor or the traction sheave to stop the elevator and to keep the elevator stationary within the hoistway. A controller supervises movement of the elevator in response to travel requests or calls input by passengers.

Generally, the brakes must satisfy strict regulations. For example, both the ASME A17.1-2000 code in the United States and European Standard EN 81-1:1998 state that the elevator brake must be capable of stopping the motor when the elevator car is travelling downward at rated speed and with the rated load plus 25%.

Furthermore, the elevator brake is typically installed in two sets so that if one of the brake sets is in anyway faulty, the other brake set still develops sufficient braking force to slow down an elevator car travelling at rated speed and with rated load.

Given the vital nature of the elevator brake, it can be important that it is tested periodically. WO-A2-2005/066057 describes a method for testing the condition of the brakes of an elevator. In an initial calibration step of the method, a test weight is applied to the drive machine of the elevator and a first torque required for driving the elevator car in the upward direction is measured. Subsequently, the test weight is removed and at least one of the brakes or brake sets of the elevator is closed. Next, the empty elevator car is driven in the upward direction with the force of the aforesaid first torque and a check is carried out to detect movement of the elevator car. If movement of the elevator car is detected, then the aforesaid at least one brake of the elevator is regarded as defective.

A similar test method is disclosed in WO-A2-2007/094777 except that instead of using a test weight for calibration, a test torque is somehow preset and stored in an undisclosed way within the controller. With at least one of the brakes applied, the preset test torque is applied by the motor to move the empty elevator car. Any movement of the car is determined by either a position encoder or a hoistway limit switch. As before, if movement of the elevator car is observed, then the aforesaid at least one brake of the elevator is regarded as defective.

In both of the above test procedures, if a faulty brake has been detected the elevator is disabled and is no longer able to fulfill passengers travel requests. The elevator remains out of commission until the effected brake is replaced.

SUMMARY

At least some embodiments of the present disclosure can provide safety while maximizing the operating efficiency of an elevator having a car driven by a motor and at least one brake to stop the car. This can be achieved by a method comprising the steps of closing a brake, increasing a torque of the motor until the car moves, registering a value indicative of the motor torque at which the car moves, comparing the registered value with a reference value, and determining the degree to which the registered value exceeds the reference value.

Rather than applying a predetermined test torque to the brake to determine whether it passes or fails as in WO-A2-2005/066057 WO-A2-2007/094777 discussed above, the torque is continually increased until the elevator car moves. A value representative of this torque, and thereby representative of the actual brake capacity or performance, is stored. On frequent repetition, the method can permit the build-up of an accurate historical record of actual brake capacity or performance.

The reference value can represent the regulatory loading conditions which the brake should withstand and hence this comparison step of the method can automatically determine whether or not the brake fulfills these regulatory loading conditions. If the registered value is less than the reference value, then the brake has failed. Alternatively, the brake is judged to have passed if the registered value is greater than or equal to the reference value.

If the brake has failed, the method can include the steps of taking the elevator out of commission and sending a maintenance request to a remote monitoring center.

If the brake has passed, the method can include the additional step of determining the degree to which the registered value exceeds the reference value. Accordingly, if the registered value exceeds the reference value by less than a predetermined margin a maintenance request can be sent automatically to a remote monitoring center. The advantage of this arrangement is that maintenance of the elevator can be carried out proactively rather than reactively as in WO-A2-2005/066057 or WO-A2-2007/094777 where the maintenance center is only aware of an issue with a specific elevator after the brake has failed and the elevator has been automatically taken out of commission. With the present method, if the brake of a specific elevator has only passed by a predetermined factor e.g. 10%, then the installation can send a signal indicating this fact to a remote monitoring center which in turn can generate a preventative maintenance order for elevator personnel to replace the brake before it actually fails. In the meanwhile, however, since the brake has in actual fact passed, the elevator can remain in operation to satisfy the travel requests of the tenants of the building.

Since the majority of brake faults develop gradually over a long period of time rather than suddenly, it is envisaged that this proactive approach will identify the substantial majority of brakes that are about to fail and thereby enable effective and scheduled replacement or repair before the brake actually does fail. Accordingly, the frequency at which the method detects an actual brake failure, causing automatic shutdown of the elevator and subsequent inconvenience to users, is greatly reduced as compared to the prior art.

The reference value can be determined by a calibration process comprising the steps of loading a test weight into the car, opening the or each brake, increasing the torque of the motor until the car moves and storing a value representative of the torque that caused the car to move as the reference value. The test weight can be selected to simulate the regulatory loading conditions which the brake must withstand. Possibly, the test weight is selected to simulate a load of at least 125% of the rated load of the car.

The values indicative of the motor torque can refer to actual torque values or, more conveniently, to values of motor parameters such as current, voltage and/or frequency, depending on the drive strategy employed, which are representative of the motor torque.

BRIEF DESCRIPTION OF THE DRAWINGS

Various exemplary embodiments of the disclosed technologies are described with respect to the accompanying drawings, wherein.

DETAILED DESCRIPTION

Figure 1:
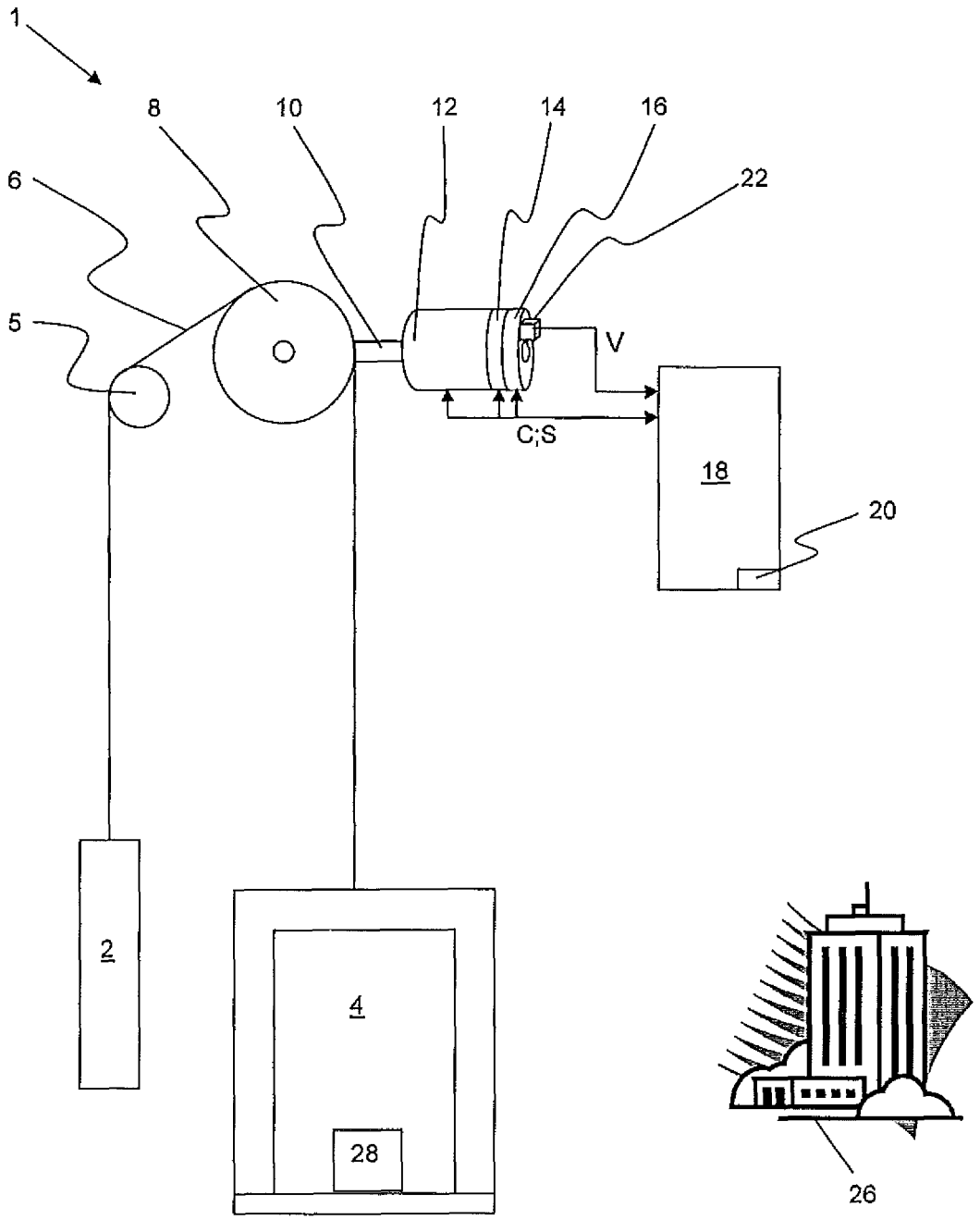
FIG. 1 is a schematic illustration of a typical elevator installation.

A typical elevator installation 1 for use with the method according to the disclosed embodiments is shown in FIG. 1. The installation 1 is generally defined by a hoistway bound by walls within a building wherein a counterweight 2 and car 4 are movable in opposing directions along guide rails. Suitable traction means 6 supports and interconnects the counterweight 2 and the car 4. In the present embodiment the weight of the counterweight 2 is equal to the weight of the car 4 plus 40% of the rated load which can be accommodated within the car 4. The traction means 6 is fastened to the counterweight 2 at one end, passed over a deflecting pulley 5 positioned in the upper region of the hoistway, passed through a traction sheave 8 also located in the upper region of the hoistway, and fastened to the elevator car 4. Naturally, the skilled person will easily appreciate other roping arrangements are equally possible.

The traction sheave 8 is driven via a drive shaft 10 by a motor 12 and braked by at least one elevator brake 14,16. The use of at least two brake sets is compulsory in most jurisdictions (see, for example, European Standard EN81-1:1998 12.4.2.1). Accordingly, the present example utilizes two independent, electro-mechanical brakes 14 and 16, Each of the brakes 14,16 includes a spring-biased brake shoe releasable against a corresponding disc mounted to the drive shaft 10 of the motor 12. Alternatively, the brake shoes could be arranged to act on a brake drum mounted to the drive shaft 10 of the motor 16 as in WO-A2-2007/094777.

Actuation of the motor 12 and release of the brakes 14,16 is controlled and regulated by command signals C from a control system 18. Additionally, signals S representing the status of the motor 12 and the brakes 14,16 are continually fed back to the control system 18. Movement of the drive shaft 10 and thereby the elevator car 4 is monitored by an encoder 22 mounted on brake 16. A signal V from the encoder 22 is fed to the control system 18 permitting it to determine travel parameters of the car 4 such as position, speed and acceleration.

The control system 18 incorporates a modem and transponder 20 permitting it to communicate with a remote monitoring center 26. Such communication can be wirelessly over a commercial cellular network, through a conventional telephone network or by means of dedicated line.

Figure 2:
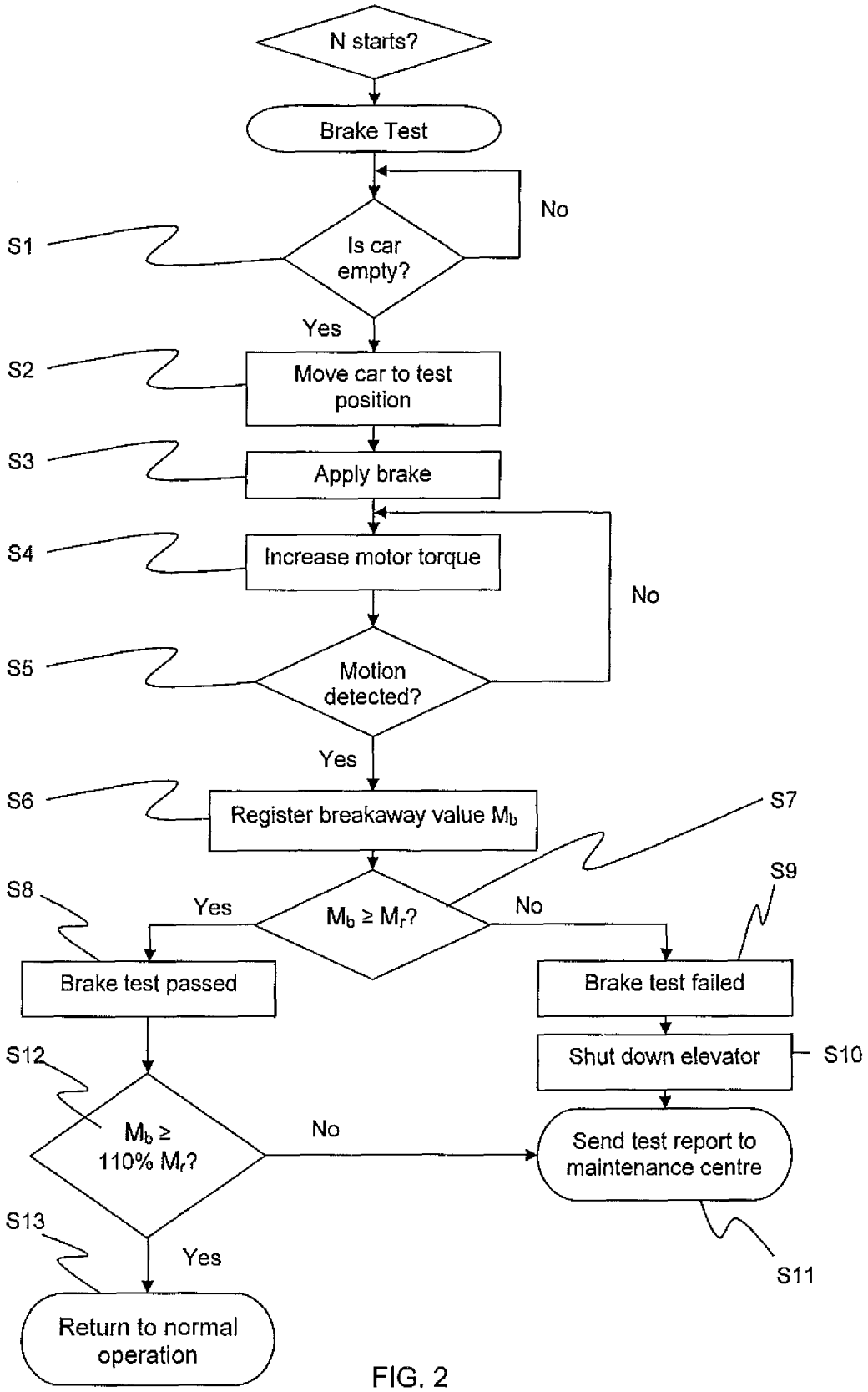
FIG. 2 is a flowchart illustrating method steps for operating an elevator.

An exemplary method will now be described with reference to the flowchart illustrated in FIG. 2.

Each of the brakes 14,16 are tested at a defined frequency. In the present example, the defined frequency refers to the number trips N the elevator has performed since the last brake test. Alternatively, the defined frequency may refer to a predetermined time interval since the last brake test.

The first step S1 in the procedure can be to ensure that the elevator car 4 is empty. The control system 18 generally receives signals indicative of car loading and door status from which it can determine whether the car 4 is empty.

When the car 4 is empty, the procedure brake test proceeds to a second step S2 in which the empty car 4 is moved to a dedicated test position within the hoistway. Possibly, the test position corresponds to the penultimate floor at the top of the building since in this position not only the counterweight 2 but also the majority of the weight of the tension means 6 counteracts the load of the empty car 4.

Next, in step S3 the brake 14,16 undergoing the test is closed or released so as to engage its associated brake disc. The control system 18 maintains the other brake 16,14 in an open or unengaged condition.

Next, the control system 18 commands the motor 12 to commence an upward, speed regulated trip. In step S4 the control system 18 increases the torque supplied to the motor 12 until the empty car 2 starts to move. As previously described, such motion is detected in step S5 by the encoder 22 which in turn informs the control system 18. As soon as the car 2 starts to move, the trip is stopped and the other brake 14,16 is closed. A value representative of the torque that caused the car 4 to move is measured and stored as a breakaway value $M_b$ in step S6.

Next, the control system 18 compares the breakaway value $M_b$ with a reference value $M_r$ which is pre-established in a calibration process that will be explained later in the description. In a first comparison step S7, if the breakaway value $M_b$ is greater or equal to the reference value $M_r$, then the brake is determined to have passed the test in step S8. Alternatively, if the breakaway value $M_b$ is less than the reference value $M_r$, then the brake is determined to have failed the test in step S9 and subsequently the elevator is shut down or taken out of commission in step S10 and a test report is sent to the remote monitoring center 26 in step S11 by the control system 18 via the modem and transponder 20. Typically the test report contains information indicating that the brake 14,16 undergoing the test has failed and the remote monitoring center 26 in turn can generate a reactive maintenance order for elevator personnel to replace the defective brake 14;16.

Even if the brake is determined to have passed the test in step S7, a second comparison step S12 determines the degree to which the breakaway value $M_b$ exceeds the reference value $M_r$. In the present example, if the breakaway value $M_b$ exceeds the reference value $M_r$ by 10% or more, then the test ends and the elevator is returned back to normal operation in step S13. However, in the alternative, if the breakaway value $M_b$ exceeds the reference value $M_r$ by less than 10%, then a test report is sent to the maintenance center in step S11. Typically this test report contains information indicating the degree to which the brake 14,16 undergoing the test passed and the remote monitoring center 26 in turn can generate a proactive maintenance order for elevator personnel to replace the brake 14,16 possibly before it actually fails.

The test is then repeated for the other brake 16,14.

During initial commissioning of the elevator installation 1 a calibration process in accordance with the disclosure of WO-A2-2005/066057 can be conducted wherein a test weight 28 is loaded into the elevator car 4, the torque of the motor 12 is increased until upward movement of the car 4 is detected by the encoder 22 and a value representative of the torque that caused the car 4 to move is measured and stored as a reference value $M_r$.

The test weight 28 is carefully selected to correspond to the loading conditions for which the brake is to be tested. In the present example, if the brakes 14,16 are required to hold a car containing 25% more than the rated load, i.e. 125% of rated load, then the brake force required from the brakes 14,16 is 85% of rated load since the counterweight 2 already balances 40% rated load (125%−40%=85%). In order to simulate this situation with motor torque acting to drive an empty car 4 upwards, as in the test procedure outlined above, the motor torque must be 45% of the rated load since the counterweight 2 already provides 40% of the rated load. Finally, to achieve a 45% upward motor torque using the test weight 28, as in the calibration process, the test weight 28 is selected to equal 85% of the rated load (85% on the car side−40% on the counterweight side=45% that must be compensated for by the motor torque).

Possibly, the calibration process is conducted with the elevator car 4 positioned at the lowermost landing of the hoistway. Firstly, this is generally the most convenient location for bringing the test weight 28 into the building and subsequently loading it into the car 4. Also, with the elevator car 4 in this position, the traction means 6 is imbalanced across the traction sheave 8 with the substantial majority of its weight acting on the car side of the traction sheave 8. Accordingly, the reference value $M_r$ not only takes into account the required test loading conditions as outlined above but additionally supports the imbalance the of the traction means 6 across the traction sheave 8. On the contrary, if the calibration stage was conducted with the elevator car 4 positioned at the uppermost landing of the hoistway, the substantial majority of the weight of the traction means 6 would act on the counterweight side of the traction sheave 8 and would detract from the measured and stored reference value. Accordingly, such a reference value would not meet the loading conditions for which the brake is to be tested.

In the procedures discussed above, the actual motor torque can be measured directly. However, it is generally more convenient to monitor a motor parameter such as current, voltage and/or frequency, depending on the drive strategy employed, and record values of that parameter representative of the motor torques required in the method.

Although the method has been described with particular reference to traction elevators, the skilled person will readily appreciate that it can also be equally applied to other elevator systems, for example, self-climbing elevators with the motor attached to the car. Similarly, the method can be applied to elevators wherein the or each brake is mounted to the car so as to engage a guide rail.

If the elevator system is overcompensated, for example, when the weight of a compensation chain or travelling rope is greater than that of the traction means, the skilled person will recognize that the car positions for conducting the calibration process and for conducting the brake test should be reversed.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A method for operating an elevator to test brakes, the elevator comprising a car driven by a motor and a brake to stop the car, the method comprising:
- closing the brake;
- increasing a torque of the motor until the car moves;
- registering a value indicative of the motor torque at which the car moves;
- comparing the registered value with a reference value; and
- controlling operation of the car in response to a result of the comparing the registered value with the reference value.

2. A method according to claim 1, further comprising determining failure of the brake if the registered value is less than the reference value.

3. A method according to claim 2, further comprising taking the elevator out of commission upon determining failure of the brake.

4. A method according to claim 2, further comprising sending a maintenance request to a remote monitoring center.

5. A method according to claim 1, further comprising determining that the brake has passed a test if the registered value is greater than or equal to the reference value.

6. A method according to claim 1, further comprising sending a maintenance request to a remote monitoring center if the registered value exceeds the reference value by less than a predetermined margin.

7. A method according to claim 6, the predetermined margin being at least 10%.

8. A method according to claim 1, the reference value having been determined by a calibration process comprising:
- loading a test weight into the car;
- opening the brake;
- increasing the torque of the motor until the car moves; and
- storing a value representative of the torque that caused the car to move as the reference value.

9. A method according to claim 8, the test weight being selected to simulate a load of at least 125% of a rated load of the car.

10. A method for operating an elevator to test brakes, the elevator comprising a car driven by a motor and a brake to stop the car, the method comprising:
- closing the brake;
- increasing a torque of the motor until the car moves;
- registering a value indicative of the motor torque at which the car moves;
- comparing the registered value with a reference value; and
- controlling operation of the car in response to a result of the comparing by taking the elevator out of commission upon determining failure of the brake when the registered value is less than the reference value and by returning the elevator to a normal operation upon determining that the brake has passed a test when the registered value is greater than or equal to the reference value.

* * * * *